US006792740B2

(12) United States Patent
Buchman

(10) Patent No.: US 6,792,740 B2
(45) **Date of Patent: *Sep. 21, 2004**

(54) METHOD OF MANUFACTURING RECLOSABLE PACKAGES USING TRANSVERSE CLOSURE AND SLIDER APPLICATOR

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/417,035

(22) Filed: Apr. 16, 2003

(65) Prior Publication Data

US 2003/0172623 A1 Sep. 18, 2003

Related U.S. Application Data

(62) Division of application No. 09/711,658, filed on Nov. 13, 2000, now Pat. No. 6,588,176.

(60) Provisional application No. 60/172,182, filed on Dec. 17, 1999.

(51) Int. Cl.[7] ..... B65B 61/18

(52) U.S. Cl. ..... 53/412; 53/133.4; 493/213

(58) Field of Search ..... 53/412, 450, 139.2, 53/133.4, 550; 493/213, 214, 927

(56) References Cited

U.S. PATENT DOCUMENTS

| | | | | |
|---|---|---|---|---|
| 3,453,799 A | * | 7/1969 | Cloud et al. | 53/455 |
| 3,986,914 A | | 10/1976 | Howard | 156/251 |
| 4,304,615 A | | 12/1981 | Siegel | 156/73.3 |
| 4,655,862 A | | 4/1987 | Christoff et al. | 156/66 |
| 4,673,383 A | | 6/1987 | Bentsen | 493/381 |
| 4,691,373 A | | 9/1987 | Ausnit | 383/63 |
| 4,709,398 A | * | 11/1987 | Ausnit | 493/214 |
| 4,876,842 A | | 10/1989 | Ausnit | 383/63 |
| 4,909,017 A | * | 3/1990 | McMahon et al. | 53/133.4 |
| 4,923,309 A | | 5/1990 | VanErden | 385/5 |
| 5,024,537 A | | 6/1991 | Tilman | 383/63 |
| 5,071,689 A | | 12/1991 | Tilman | 428/121 |
| 5,431,760 A | | 7/1995 | Donovan | 156/66 |
| 5,519,982 A | * | 5/1996 | Herber et al. | 53/412 |
| 5,711,609 A | | 1/1998 | Simonsen | 383/63 |
| 5,816,018 A | | 10/1998 | Bois | 53/133.4 |
| 5,882,749 A | | 3/1999 | Jones et al. | 428/35.2 |
| 5,950,285 A | | 9/1999 | Porchia et al. | 24/400 |
| 6,138,439 A | * | 10/2000 | McMahon et al. | 53/139.2 |
| 6,148,588 A | | 11/2000 | Thomas et al. | 53/412 |
| 6,212,857 B1 | * | 4/2001 | Van Erden | 53/133.4 |
| 6,588,176 B1 | * | 7/2003 | Buchman | 53/412 |

FOREIGN PATENT DOCUMENTS

| | | |
|---|---|---|
| EP | 0 516 393 A1 | 12/1992 |
| EP | 0 951 989 A1 | 10/1999 |
| EP | 0 959 013 A2 | 11/1999 |
| JP | 62-135160 | 6/1987 |

* cited by examiner

*Primary Examiner*—John Sipos
(74) *Attorney, Agent, or Firm*—Tracey D. Beiriger

(57) ABSTRACT

A method of making packages having a reclosable zipper construction openable and closeable by a slider device by a horizontal form, fill and seal process. The method includes applying the slider device to the zipper construction prior to incorporating the zipper construction with the package film to form the package. The zipper construction is first applied and adhered to one half of the package film and then to the other half. A tamper-evident seal may be provided encasing the slider device to provide indication whether access has been gained to the slider device and the interior of the package.

15 Claims, 5 Drawing Sheets

METHOD OF MANUFACTURING RECLOSABLE PACKAGES USING TRANSVERSE CLOSURE AND SLIDER APPLICATOR

Priority under 35 U.S.C. § 119(e) is a division to utility application Ser. No. 09/711,658, filed Nov. 13, 2000, now U.S. Pat. No. 6,588,176 which claims priority to provisional application serial No. 60/172,182, filed Dec. 17, 1999, and entitled "Methods of Manufacturing Reclosable Package Using Transverse Closure and Slider Applicator". The complete disclosure of application Ser. No. 09/711,658 is incorporated by reference herein.

FIELD OF THE INVENTION

This disclosure concerns reclosable packages. In particular, this disclosure describes methods of manufacturing reclosable packages using form, fill, and seal machines, the packages having slider devices for opening and closing the packages, and the packages made thereby.

BACKGROUND OF THE INVENTION

Form, fill, and seal technology is known in the packaging industry as a method to package consumable goods. Consumable goods that are not used completely when the package is initially opened rely on a zipper closure to reclose the package and keep the remaining contents fresh. Examples of consumable goods that are often packaged in packages, such as bags, with a zipper closure include potting soil, fertilizer, pet food, dog biscuits, vegetables, cereal and many other foods edible by humans.

Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. For some applications, a tamper-evident seal, to indicate whether access has been gained to the zipper closure, is desired. Improvements in these types of packages are desirable.

SUMMARY OF THE INVENTION

The present disclosure relates to a method of manufacturing a package, such as a flexible bag, having a resealable, reclosable zipper mechanism, opening and closing of which is accomplished by a slider device mounted on the zipper mechanism. A tamper-evident seal can be provided on the exterior or interior of the slider device so as to provide evidence whether access has been gained to the interior of the package. Alternately or additionally, a hermetic peel seal can be included in the package.

In particular, the present disclosure relates to a form, fill and seal process that manufactures the flexible package, fills the package with items, and seals the filled package. The zipper mechanism, the slider, and seals are applied to the package, preferably in the same process as filling of the package.

The methods of this disclosure involve, in general, providing a length of a zipper closure construction having interlocking closure members, incorporating a "park" notch within the zipper, locating the slider device within close proximity to the "park" notch, attaching the zipper and slider to side panels as appropriate to provide a package. The zipper closure is cut to the desired length, e.g., the width of the package, and the slider device is mounted thereon prior to incorporation of the zipper closure with the side panels.

In particular, the present disclosure is directed to a method of manufacturing a reclosable package having a zipper closure construction and a slider device. The method includes providing a zipper closure construction having a first closure profile and a second closure profile, the closure construction having a length approximately equal to the resulting package width. A slider device, constructed and arranged for mounting on the closure construction and for interlocking the first closure profile with the second closure profile when the slider device is moved in a first direction, and for disengaging the first closure profile from the second closure profile when the slider device is moved in a second opposite direction, is provided and mounted onto the closure construction. The closure construction, with the slider device mounted thereon, is attached to a first half of a film web and to a second half of the film web. Side edges, a bottom edge, and a top edge are formed to provide a package having an interior for accepting items therein. In another embodiment, the method includes filling the package and then forming a side edge.

The present disclosure also is directed to packages made by the methods disclosed.

DETAILED DESCRIPTION OF PREFERRED EMBODIMENTS

The addition of a slider device to a zipper closure construction of a package, such as a bag, is advantageous to aging or arthritic persons not having the physical ability to use just the zipper closure to reseal a bag. Additionally, the addition of a slider device to a package facilitates the use of the bag by users of all ages and abilities. The process described herein produces and fills a reclosable package having a slider device present to facilitate opening and closing of the zipper closure. In some embodiments, a tamper-evident seal or structure and/or a peel seal is also provided by the process described herein. The process of manufacturing the packages is accomplished by a process commonly referred to as a form, fill, and seal process.

Figure 1:
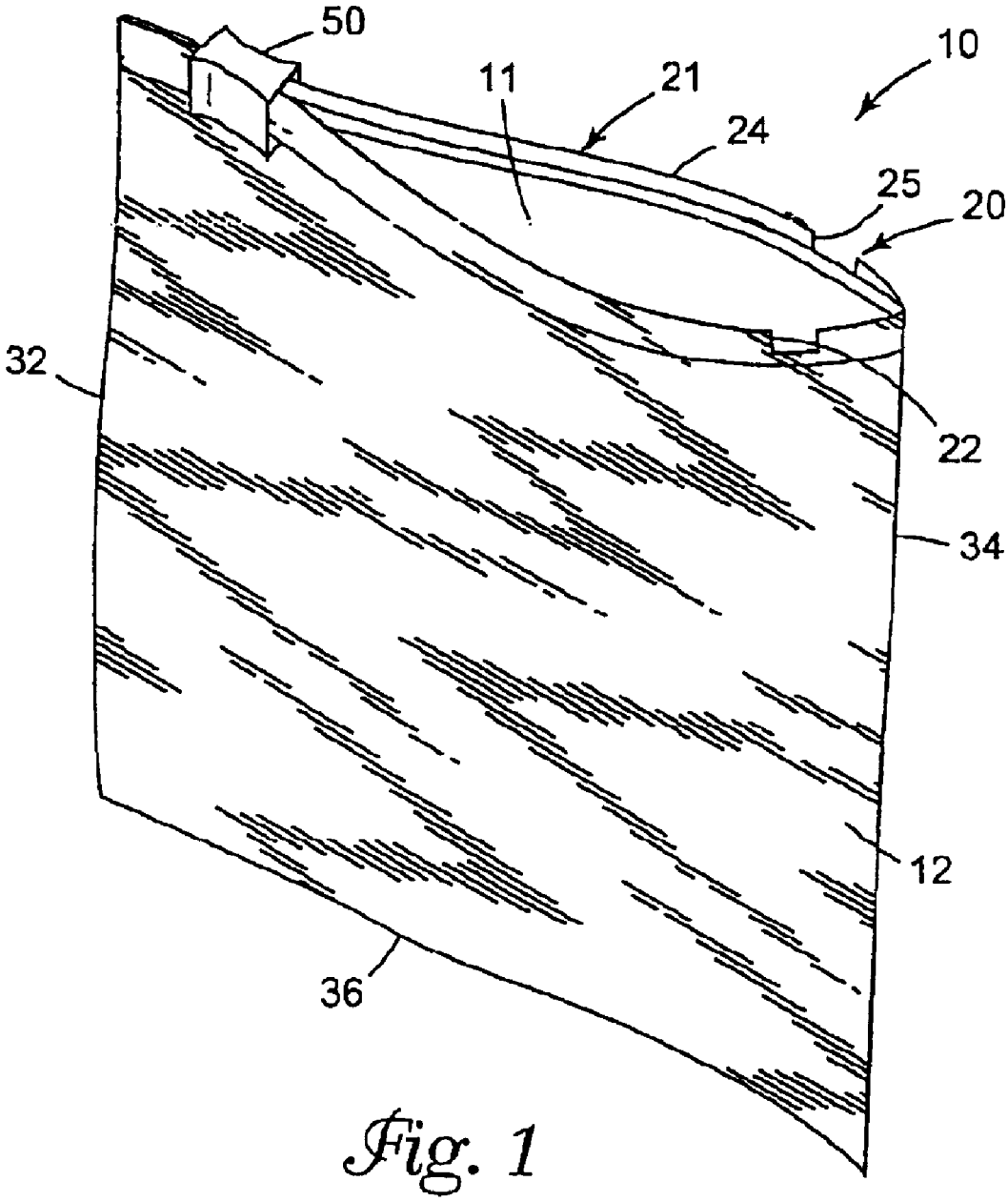
FIG. 1 is a perspective view of a flexible, reclosable package shown with access available to the interior of the package.
Figure 2:
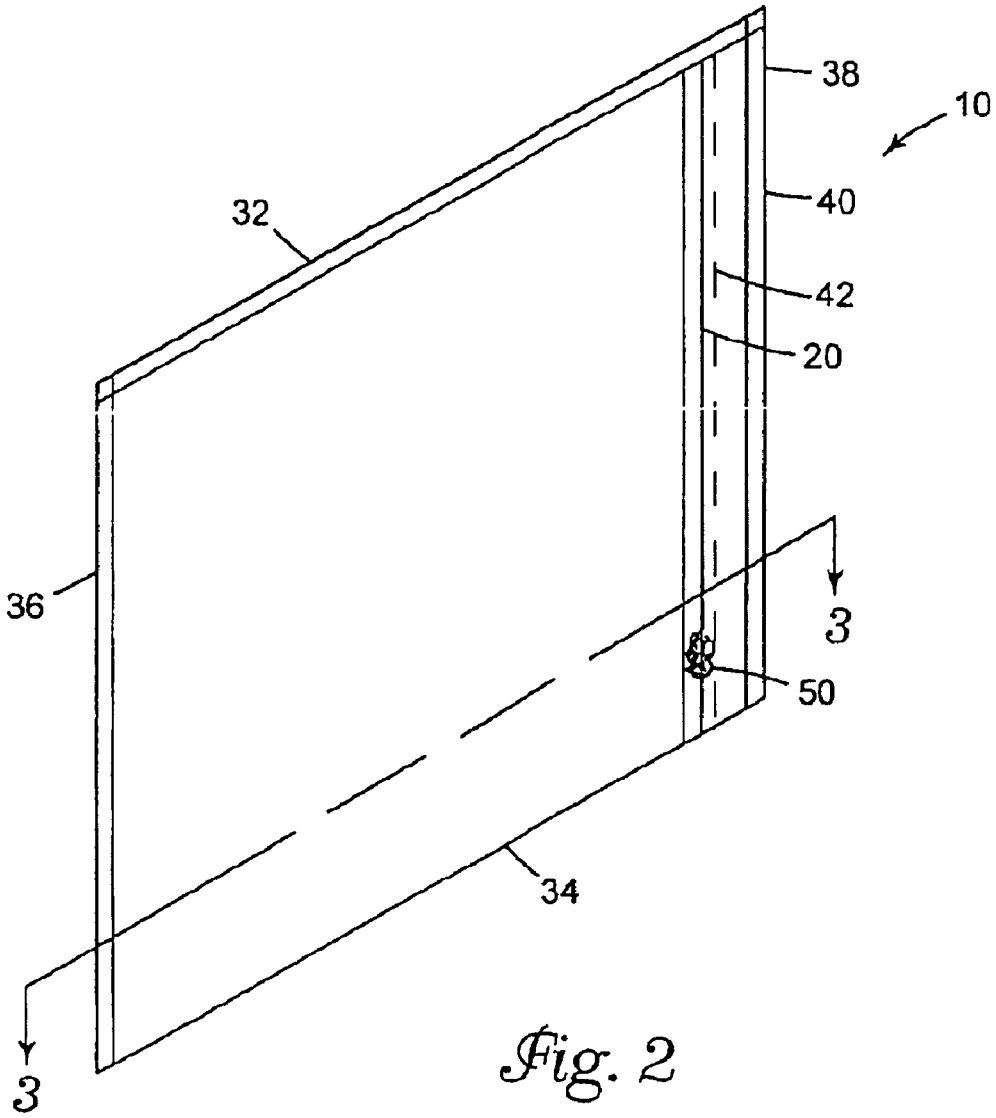
FIG. 2 is a side view of the flexible, reclosable package depicted in FIG. 1 in a different orientation, having a tamper-evident structure covering the zipper closure construction and blocking access to the interior of the package.
Figure 3:
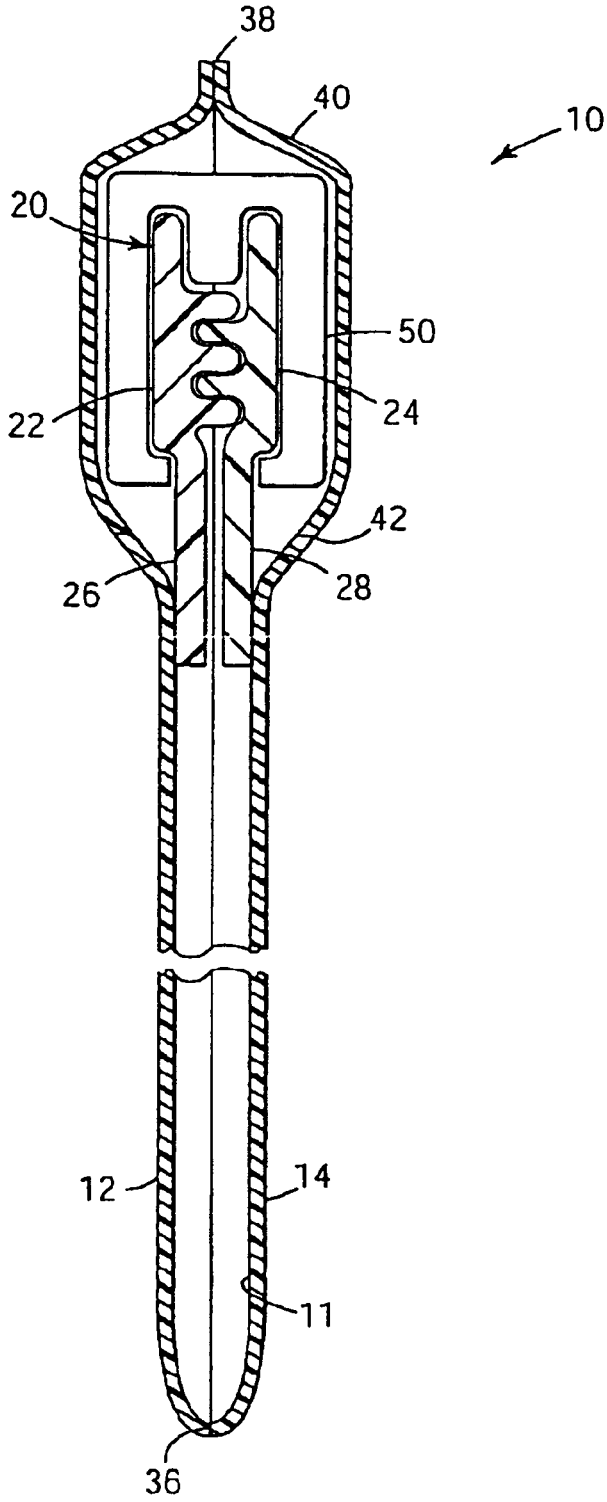
FIG. 3 is a cross-sectional view of the flexible, reclosable package taken along line 3—3 of FIG. 2.

A flexible, reclosable package 10 is shown in FIGS. 1, 2 and 3. In FIGS. 2 and 3, a tamper-evident structure covering the slider device and zipper closure construction is intact, blocking access to the interior of package 10; in FIG. 1, the tamper-evident structure has been removed from package 10 to provide access to the interior of package 10.

Package 10 has polymeric film side panels 12 and 14 defining an interior 11, as best seen in FIG. 3. Access is gained to interior 11 through a mouth 21 (FIG. 1). A zipper closure arrangement 20 having mating profiles to open and close (unseal and reseal) the mouth 21 of package 10 extends across the width of package 10. The zipper closure 20 can include a variety of configurations and structures. Best seen in FIGS. 1 and 3, zipper closure 20 has a first mating profile 22 and a second mating profile 24 that engage, interlock, or otherwise mate. Zipper closure 20 can be configured in any known manner, for example, such as disclosed in U.S. Pat. Nos. 4,240,241; 4,246,288; and 4,437,293; each of which is incorporated by reference herein. First mating profile 22 and second mating profile 24 engage and disengage, as appropriate, to open and close package 10.

First and second mating profiles 22, 24 of zipper closure 20 are attached to side panels 12, 14, respectively, by sealing flanges 26, 28 as depicted in FIG. 3. Package 10 includes three edges, side edges 32, 34 and bottom edge 36 (FIGS. 1 and 2), where side panels 12, 14 are connected to each other to form interior 11 of package 10. Side edge 32 and bottom edge 36 are seals created by the application of heat and pressure to side panels 12, 14. Side edge 34 is a fold line between side panels 12, 14, which is formed when a single sheet of film is folded to form the two side panels 12, 14. Zipper closure 20 extends from side edge 32 to side edge 34 at top edge 38.

A slider device 50 is operably mounted on zipper closure 20 to facilitate opening and closing of zipper closure 20. Slider devices and how they function to open and close zipper closures, in general, are taught, for example, in U.S. Pat. Nos. 5,063,644; 5,301,394; 5,442,837, and 5,664,229, each of which is incorporated by reference herein. A preferred slider device is taught in U.S. patent application Ser. Nos. 09/365,215 and 29/108,657, both filed Jul. 30, 1999, and in U.S. provisional patent application No. 60/222,132, filed Jul. 31, 2000, all which are incorporated herein by reference in their entirety.

A notch 25 (FIG. 1) is disposed within zipper closure 20. Notch 25 is designed to provide a "park place" into which slider device 50 settles when zipper closure 20 is sealed. Notch 25 may decrease any tendency for an incomplete interlock between first mating profile 22 and second mating profile 24.

In FIGS. 2 and 3, package 10 includes a tamper-evident structure 40 positioned over slider device 50 and zipper closure 20. By "tamper-evident", it is meant that it provides an indication to the consumer as to whether the package 10 has been previously opened. In order to access the interior 11 of package 10 through mouth 21, the tamper-evident structure 40 needs to be penetrated. In the embodiment depicted in FIGS. 2 and 3, tamper-evident structure 40 covers and forms a complete enclosure around the zipper closure 20 and slider device 50. Tamper-evident structure 40 is formed by sealing the tops of side panels 12, 14 over slider device 50 at top edge 38, as best seen in FIG. 3. In order to gain access to slider device 50 and the package interior 11, the tamper-evident structure 40 needs to be penetrated. Tamper-evident structure 40 includes a perforation line 42, shown in FIGS. 2 and 3, which allows for easy removal of tamper-evident structure 40. In some package embodiments, perforation line 42 is a tear-strip, die line, zip strip, or any type of weakened area that allows for easy removal of tamper-evident structure 40 to expose zipper closure 20 and slider device 50. In FIG. 1, the tamper-evident structure 40 of FIGS. 2 and 3 is shown already removed from package 10 to allow access to interior 11 of package 10 through mouth 21.

Various modifications of tamper-evident structures are known throughout the art of resealable packaging. For example, a second tamper-evident structure, such as a web of polymeric film, can be positioned between sealing flanges 26, 28, thus providing a second barrier that needs to breached in order to gain access to interior 11 of package 10. Similarly, a peel seal can be positioned between sealing flanges 26, 28 of zipper closure 20 to provide a hermetic barrier for the interior 11. A peel seal can be resealable; that is, it can be opened and resealed multiple times. Alternately, a peel seal can be a single use seal, which, once broken, cannot be resealed. These internal tamper-evident structures, i.e., those between the zipper closure 20 and package interior 11, can be used with or without an external tamper-evident structure, such as structure 40.

The package described and disclosed in FIGS. 1 through 3 can be manufactured by a horizontal form, fill and seal machine in accordance with the present disclosure. The package, whether with or without a second tamper-evident seal and/or a peel seal, is manufactured, filled, and sealed by a single process that includes multiple sequential steps. The zipper closure 20, slider device 50, tamper-evident structure 40, and any optional features are applied to the package prior to the package being filled with any items.

Figure 4:
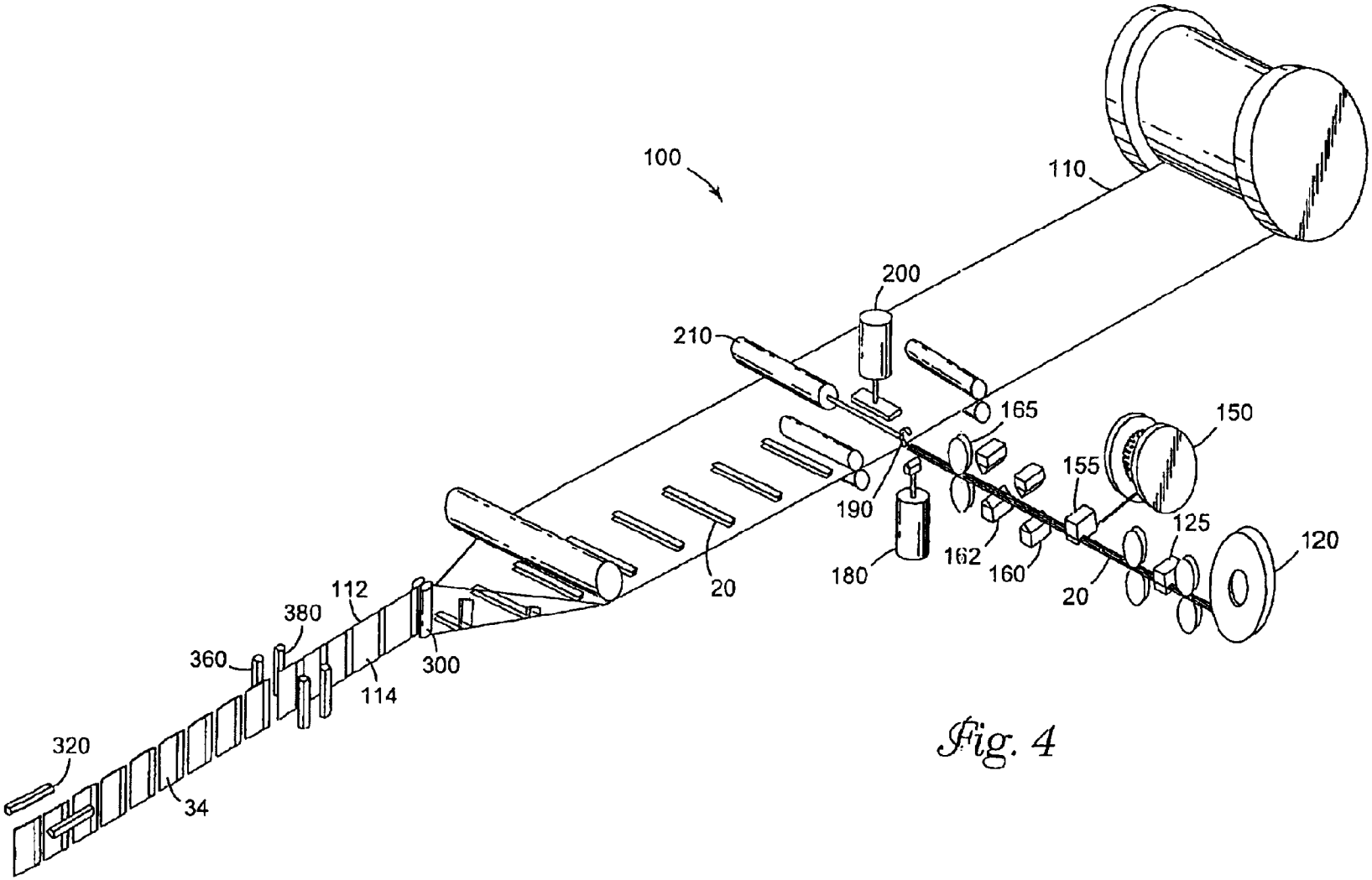
FIG. 4 is a schematic, perspective view of a process of the present disclosure for producing a flexible, reclosable package similar to that depicted in FIGS. 1 through 3.
Figure 5:
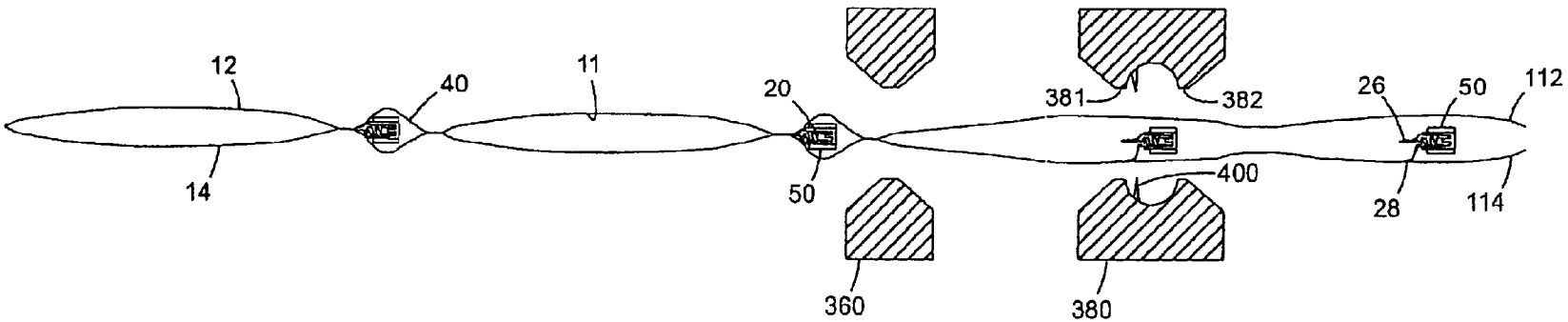
FIG. 5 is a top view of a portion of the process depicted in FIG. 4.

Referring to FIG. 4, a horizontal form, fill and seal process, in accordance with the present disclosure, is shown at 100. FIG. 5 is a top view of a portion of the process of FIG. 4. As illustrated in FIGS. 4 and 5, the process line progresses from right to left; that is, the final filled package is at the left side of the figures. The bag or package is manufactured in a sideways orientation so that the filling takes place through a side edge of the package, such as through side edge 32 (FIGS. 1 and 2). In FIG. 2, package 10 is oriented in the position in which it is manufactured by process 100 of FIG. 4. Side edge 34 is positioned at the bottom of the process, and filling of package 10 is accomplished through side edge 32.

Referring to FIG. 4, the process to manufacture and fill package 10 of FIGS. 1 through 3 will be described. Polymeric film 110, which forms side panels 12, 14 (FIGS. 1 through 3), is provided on a roll. The width of polymeric film 110 is approximately equal to twice the width of package 10; that is, the width of film 110 is approximately twice the distance between side edge 32 and side edge 34. In another embodiment, film 110 may be extruded, cast or otherwise formed immediately before this horizontal form, fill and seal process, thereby eliminating the step of winding the film after forming the film and then unwinding when the packages are made.

An extended length of zipper closure 20 (with first closure profile and second closure profile interlocked) is provided via spool 120. In another embodiment, the extended length of zipper closure 20 may be extruded, cast or otherwise formed immediately before this horizontal form, fill and seal process, thereby eliminating the step of winding the zipper closure after forming the zipper and then unwinding when the packages are made. Notch 25 (FIG. 1) is punched into zipper closure 20 by an in-line punch 125 that may be a die, knife, stamp or other such process. Notch 25 is formed in the profile of the zipper closure 20 before the zipper closure 20 is incorporated into the resulting package 10.

An extended length of zipper closure 20 (with first closure profile and second closure profile interlocked) is provided via spool 120. In another embodiment, the extended length of zipper closure 20 may be extruded, cast or otherwise formed immediately before this horizontal form, fill and seal process, thereby eliminating the step of winding the zipper closure after forming the zipper and then unwinding when the packages are made. Notch 25 (FIG. 1) is punched into zipper closure 20 by an in-line punch 125 that may be a die, knife, stamp or other such process. Notch 25 is formed in the profile of the zipper closure 20 before the zipper closure 20 is incorporated into the resulting package 10.

In accordance with the present disclosure, zipper closure 20, with slider device 50 thereon, is cut to a length approximately equal to the width of the resulting package. That is, zipper closure 20 is cut to the length needed to extend between side edge 32 and side edge 34 of package 10 (FIGS. 1 and 2), as described below.

Zipper closure 20 is contacted by a pair of first sealing bars 160 and a pair of second sealing bars 162, which apply heat and pressure to zipper closure 20 at the areas of contact. Preferably, the heat and pressure applied by sealing bars 160, 162 is sufficient to securely seal first and second mating profiles of zipper closure 20 together. First and second sealing bars 160, 162 are spaced to be equal to the width of the resulting package 10. The resulting zipper closure extension is one that has beat seals present along its length; the heat seals are spaced to correspond to where the zipper closure 20 will eventually meet side edges 32, 34 of package 10.

Zipper closure 20 is contacted by a pair of first sealing bars 160 and a pair of second sealing bars 162, which apply heat and pressure to zipper closure 20 at the areas of contact. Preferably, the heat and pressure applied by sealing bars 160, 162 is sufficient to securely seal first and second mating profiles of zipper closure 20 together. First and second sealing bars 160, 162 are spaced to be equal to the width of the resulting package 10. The resulting zipper closure extension is one that has heat seals present along its length; the heat seals are spaced to correspond to where the zipper closure 20 will eventually meet side edges 32, 34 of package 10.

In some embodiments, it may be desired to apply slider device 50 onto zipper closure 20 after zipper closure 20 has been cut to length. Similarly, notch 25 may be punched after zipper closure 20 has been cut to length. In yet further embodiments, it may be desired to apply slider device 50 to zipper closure 20 prior to punching notch 25, whether before or after cutting zipper closure 20 to length. Regardless of the order that notch 25 is punched, slider device 50 is mounted, and zipper closure 20 is cut to length, all these functions have been performed prior to zipper closure 20 being sealed to film 110.

The cut zipper closure 20, with slider device 50 positioned thereon, is positioned onto film 110 by profile positioner 210 and profile gripper 190. Profile positioner 210 pulls zipper closure 20 into its correct position on film 110 and profile gripper 190 provides tension on zipper closure 20 in the opposite direction so that profile positioner 210 does not pull zipper closure 20 too far. The cut length of zipper closure 20 is positioned on film 110 so that zipper closure 20 extends from approximately one edge of film 110 to its centerline. Zipper closure 20 can be somewhat recessed from the edge. Preferably, zipper closure 20 does not extend over the centerline of film 110, as this would cause difficulties when film 110 is folded. Similarly, zipper closure 20 preferably does not extend short of the centerline, as this could leave an unsealed gap in the final package. A profile applicator 200 adheres, and optionally actually seals, zipper closure 20 to film 110. This adhering process is preferably performed in such a manner that slider device 50 is not crushed or otherwise damaged by profile applicator 200 or other fixtures. Only one half of zipper closure 20, that is, the side positioned on film 110, is attached to film 110 by profile applicator. In particular, one of the sealing flanges, such as sealing flange 28 (FIG. 3), is attached to film 110.

During the punching of notch 25 by punch 125, the application of slider device 50 by slider applicator 155, and the positioning of zipper closure 20 onto film 110, the zipper closure 20 is moving in an incremental fashion. Typically, film 110 is also moving in an incremental fashion as zipper closure 20 is applied and the packages are made. Various rollers, guides, and the like can be used throughout process 100 to guide film 110 and secure the attachment of zipper closure 20 onto film 110.

Once the zipper closure 20 is attached to film 110, for example by sealing flange 28, film 110 is folded along its centerline by folding station 300 to form two film halves 112, 114. Preferably, the two film halves 112, 114 are the same; that is, they have equal dimensions. The film halves 112, 114 with the zipper closure 20 and slider device 50 therebetween progress to sealing bars 360, 380. In FIG. 5, an enlarged top view of film halves 112, 114, zipper closure 20 with slider device 50 mounted thereon, and sealing bars 360, 380 is shown. Zipper closure 20, with slider device 50 thereon, is attached to film half 114 by second sealing flange 28 (FIG. 3), and likewise sealing flange 26 (of mating profile 22 (FIG. 3)) is now sealed to film half 112.

Film halves 112, 114, with zipper closure 20 therebetween, incrementally progress to sealing bars 360, 380. Typically, each of sealing bars 360, 380 is a pair of bars, each on opposite sides of film halves 112, 114. The sealing bars 360, 380 provide heat and pressure to portions of film halves 112, 114 to form heat seals therebetween. In some embodiments, the temperature from one side may be the same or may be different than the temperature of the opposite side. Sealing bars 360 may have different temperatures than sealing bars 380.

Sealing bars 360 provide the seal that results at bottom edge 36 of package 10 (see FIG. 2). Sealing bars 380 have two sealing surfaces 381 and 382 (FIG. 5), and include a perforator 400. First and second surfaces 381, 382 of sealing bars 380 are designed to provide a seal on each side of slider device 50. In particular, first surface 381 seals film half 112 to first sealing flange 26 and optionally reinforces the seal between film half 114 and second sealing flange 28. Second surface 382 of sealing bars 380 seals film half 112 to film 114, thereby creating tamper-evident structure 40 (FIGS. 2 and 3) which encases slider device 50. Perforator 400 provides a perforation 42 (FIGS. 2 and 3), score, or other weakness in film halves 112, 114, that allows tamper-evident structure 40 to be removed to gain access the zipper closure 20 when the package is used. In some embodiments, it may be desired to provide a perforated or weakened area in the film as an individual step, rather than simultaneously, with the creation of the seals. Further, a weakened or perforated area can be provided in film 110 at any point in the process 100, including prior to winding film 110 on a spool.

The majority of film halves 112, 114 are not sealed together, thus providing individual side panels 12, 14 and interior 11 of package 10 for accepting items therein, as depicted in FIG. 5.

In some embodiments, sealing bars 360 are not present in the process; rather, second surface 382 of sealing bars 380 produces the seal to provide tamper-evident structure 40 at top edge 38 and also the seal at bottom edge 36. In further embodiments, it may be desired to use multiple seal bars in place of either one of or each of sealing bars 360, 380; this may be desired as the production speed of the process increases.

In some embodiments, the process of the present invention includes production of packages that have no tamper-evident structure 40 external to the slider device 50. Rather, no tamper-evident structure, only an internal tamper-evident structure, or no tamper-evident structure is present. An internal tamper-evident structure may be a peel seal between either side panels 12, 14 or between sealing flanges 26, 28. Another type of internal tamper-evident structure can be formed by sealing together sealing flanges 26, 28 to create a barrier to interior 11 of the package. Alternately, zipper closure 20 can be produced as a single piece, with sealing flange 26 connected to sealing flange 28.

Referring again to FIG. 4, after film 110 is folded by folding station 300 and the side seams are made, that is, the seals at bottom edge 36 and top edge 38, by sealing bars 360, 380, any items or material can be deposited into the interior 11 of the formed package. Prior to filling the package, the package may progress through various stations such as a cut-off station that separates individual packages, a pouch pick-up station that orients the package for filling, an air-jet station that supplies a stream of air into the package to thoroughly open the package for filling, and other such stations. In some embodiments, it is desired to leave multiple packages attached as a chain for filling, and then cutting and separating individual packages after filling. In some embodiments, the packages may not be immediately filled, but are collected as a spool of connected packages to be later filled.

A seal bar 320 located at the top of the line is used to provide side edge 32 of the package and seal any contents within the package.

Having described the presently preferred embodiments, it is to be understood that the invention may be otherwise embodied within the scope of the appended claims.

What is claimed is:

1. A method of making and filling a reclosable package comprising a zipper closure and a slider device, the method comprising:

(a) providing a closure construction having a first closure profile and a second closure profile, the closure construction having a length approximately equal to the package width;

(b) providing a slider device constructed and arranged for mounting on the closure construction and for interlocking the first closure profile with the second closure profile when the slider device is moved in a first direction, and for disengaging the first closure profile from the second closure profile when the slider device is moved in a second opposite direction;

(c) mounting the slider device onto the closure construction;

(d) attaching the closure construction with the slider device mounted thereon transversely across a first half of a film web;

(e) attaching the closure construction with the slider device mounted thereon transversely across a second half of the film web;

(f) forming a first side edge, a bottom edge, and a top edge, the top edge proximate to the closure construction with the slider mounted thereon and opposite to the bottom edge, and leaving unsealed an open side edge adjacent the top edge and the bottom edge and opposite the first side edge;

(g) filling the resealable package through the open side edge with an item; and (h) forming a second side edge to seal the open side edge after filling, the second side edge connecting the bottom edge and the top edge.

2. The method according to claim 1, further comprising, between the step of attaching the closure construction with the slider device mounted thereon to a first half of a film web and the step of attaching the closure construction with the slider device mounted thereon to a second half of the film web:

(a) folding the film web along a centerline.

3. The method according to claim 1, wherein the step of mounting the slider device onto the closure construction comprises:

(a) punching a notch in the closure construction; and (b) mounting the slider device into the notch of the closure construction.

4. The method according to claim 1, wherein the step forming a first side edge, a bottom edge, and a top edge comprises forming a top edge comprising a tamper-evident structure over the slider device.

5. The method according to claim 1, wherein the step of providing a closure construction having a first closure profile and a second closure profile, the closure construction having a length approximately equal to the package width comprises:

(a) cutting an extended length of closure construction to a length approximately equal to the package width.

6. A method of manufacturing a reclosable package comprising a zipper closure construction and a slider device, the reclosable package having a width and the zipper closure extending the width of the package, the method comprising:

(a) providing a closure construction having a first closure profile and a second closure profile, the closure construction having a length approximately equal to the package width;

(b) providing a slider device constructed and arranged for mounting on the closure construction and for interlocking the first closure profile with the second closure profile when the slider device is moved in a first direction, and for disengaging the first closure profile from the second closure profile when the slider device is moved in a second opposite direction;

(c) mounting the slider device onto the close construction;

(d) attaching the closure construction with the slider device mounted thereon transversely across a first half of a film web;

(e) attaching the closure construction with the slider device mounted thereon transversely across a second half of the film web;

(f) forming a first side edge;

(g) forming a bottom edge;

(h) forming a top edge proximate to the closure construction with the slider device mounted thereon opposite the bottom edge; and (i) leaving unsealed a second side edge until the reclosable package is filled by a later operation, the second side edge opposite the first side edge and connecting the bottom edge and the top edge.

7. The method according to claim 6, further comprising, between the step of attaching the closure construction with the slider device mounted thereon to a first half of a film web and the step of attaching the closure construction with the slider device mounted thereon to a second half of the film web:

(a) folding the film web along a centerline.

8. The method according to claim 6, wherein the step of mounting the slider device onto the closure construction comprises:

(a) punching a notch in die closure construction; and (b) mounting the slider device onto the closure construction.

9. The method according to claim 8, wherein the step of punching a notch in the closure construction is done before the step of mounting the slider device onto the closure construction.

10. The method according to claim 6, wherein the step of forming a top edge comprises:

(a) providing a tamper-evident structure over the slider device to indicate whether access has been gained to the slider device.

11. The method according to claim 6, wherein the step of providing a tamper-evident structure over the slider device to indicate whether access has been gained to the slider device comprises providing a tamper-evident structure over the slider device by sealing the first half of the film web to the second half of the film web.

12. The method according to claim 11, wherein the step of providing a tamper-evident structure over the slider device by sealing the first half of the film web to the second half of the film web is accomplished simultaneously with the step of attaching the closure construction with the slider device mounted thereon to a second half of the film web.

13. The method according to claim 6, wherein the step of providing a closure construction having a first closure profile and a second closure profile, the closure construction having a length approximately equal to the package width comprises:

(a) cutting an extended length of closure construction to a length approximately equal to the package width.

14. The method according to claim 13, wherein the step of cutting an extended length of closure construction to a length approximately equal to the package width is done after the step of mounting the slider device onto the closure construction.

15. The method according to claim 13, wherein prior to the step of cutting an extended length of closure construction to a length approximately equal to the package width, the method comprises:

(a) sealing together the first closure profile and the second closure profile of the closure constriction.

* * * * *